US006382280B1

(12) United States Patent
Sands

(10) Patent No.: US 6,382,280 B1
(45) Date of Patent: May 7, 2002

(54) TRANSFORMABLE PURSE

(75) Inventor: Karen Sands, Belmont, MA (US)

(73) Assignee: Karen Sands & Associates, Inc., Belmont, MA (US)

( * ) Notice: Subject to any disclaimer, the term of this patent is extended or adjusted under 35 U.S.C. 154(b) by 0 days.

(21) Appl. No.: 09/703,737

(22) Filed: Nov. 1, 2000

(51) Int. Cl.[7] ..... A45C 13/06; A45C 13/10
(52) U.S. Cl. ..... 150/124; 150/105; 150/123
(58) Field of Search ..... 150/105, 103, 150/104, 124, 120, 123

(56) References Cited

U.S. PATENT DOCUMENTS

| | | | | | |
|---|---|---|---|---|---|
| 851,421 | A | * | 4/1907 | Hiering et al. | 150/105 X |
| 1,537,210 | A | * | 5/1925 | Wood | 150/105 X |
| 2,019,693 | A | * | 11/1935 | Perl | 150/105 X |
| 2,572,683 | A | * | 10/1951 | Wachs | 150/105 X |
| 3,093,176 | A | * | 6/1963 | Kahn | 150/105 X |
| 3,182,701 | A | | 5/1965 | Ginsburg | |
| 3,234,985 | A | | 2/1966 | Gilbert | |
| 3,536,116 | A | | 10/1970 | Margolis | |
| 4,027,710 | A | | 6/1977 | Keebler | |
| 4,707,889 | A | * | 11/1987 | Sato | 150/105 X |
| 4,907,633 | A | | 3/1990 | Eckstein | |
| 5,533,558 | A | | 7/1996 | Carey et al. | |
| 5,911,262 | A | | 6/1999 | Steinhart | |
| 6,003,573 | A | | 12/1999 | Owens | |
| 6,129,126 | A | | 10/2000 | Restivo | |

* cited by examiner

*Primary Examiner*—Allan N. Shoap
*Assistant Examiner*—Tri M. Mai
(74) *Attorney, Agent, or Firm*—Cesari and McKenna, LLP; John F. McKenna

(57) ABSTRACT

A purse comprises a frame including a pair of elongated parallel rails and a pair of V-frames connected to opposite end of the rails which allow the rails to be moved between spaced apart and closed together positions. A cover defining an enclosure is sized to fit around the frame when the rails are in both of their positions. The cover includes opposite side walls with upper edge margins and cooperating fastening means on the frame and on the cover for releasably securing the side wall upper edge margins of the cover to the rails of the frame.

2 Claims, 2 Drawing Sheets

TRANSFORMABLE PURSE

This invention relates to a clothing accessory. It relates more particularly to a woman's purse or clutch of the type normally used to carry cosmetics, keys, wallets and the like.

BACKGROUND OF THE INVENTION

A woman's purse or clutch normally comprises a frame and a flexible cover secured to the frame which defines an enclosure or pouch. The frame is designed so that it can be opened and closed. It usually consists of a pair of V-frames, the lower legs of each V-frame being hinged together and the upper ends of the legs in the frame pair being connected by parallel rails. When the parallel rails are spread apart, there is an opening into the top of the cover. On the other hand, when the rails are brought together, that opening is closed. Usually some means are provided for releasably securing the two rails together to maintain the purse in its closed condition. Sometime also, the opposite ends of a strap are connected to opposite ends of one of the rails to provide a loop so that the purse can be hung from the shoulder.

Invariably purses of this general type have a fixed cover with a particular exterior and/or design or color. Therefore, a purse is selected for use only when it coordinates with the color and design of the user's clothing. This means that if a woman has an extensive wardrobe, she must also possess a variety of different purses to match the different dresses comprising that wardrobe. Not only does this have cost implications, it also means that storage space must be provided for the assortment of purses.

It would be desirable, therefore, to be able to minimize the number of different purses needed to satisfy a woman's wardrobe requirements.

SUMMARY OF THE INVENTION

Accordingly it is an object to the present invention to provide a woman's purse which can have a variety of different exterior colors and ornamental designs.

Another object of the invention is to provide a woman's purse whose exterior appearance can be transformed to suit a variety of different formal and informal occasions.

Still another object of the invention is to provide a transformable woman's purse or clutch which is relatively easy to make and whose cost should not be appreciably higher than that of a conventional woman's purse.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, my purse or clutch comprises a frame and a cover which is removable from the frame enabling a variety of different covers having different exterior designs to be mounted to the frame. As usual, the frame may comprise V-frames connected by parallel rails. However, in one purse embodiment the rails are formed as long clips which releasably engage opposite upper edge margins of the cover to secure the cover to the frame. In a second purse embodiment, the upper edge margins of the cover are secured to the frame by fastening them to a liner permanently attached to the frame at locations adjacent to the rails. Both embodiments allow a woman to change the exterior color and/or design of the purse to coordinate with the clothing she is wearing simply by substituting a different cover. Resultantly, by being able to purchase a single purse frame with a variety of purse covers, she should be able to satisfy all of her wardrobe requirements at minimum cost. Also, since the covers fold flat, there is a savings in the amount of drawer or closet space required for storage.

BRIEF DESCRIPTION OF THE DRAWINGS

For a fuller understanding of the nature and objects of the invention, reference should be made to the following detailed description taken in connection with the accompanying drawings, in which.

DESCRIPTION OF PREFERRED EMBODIMENTS

Figure 1:
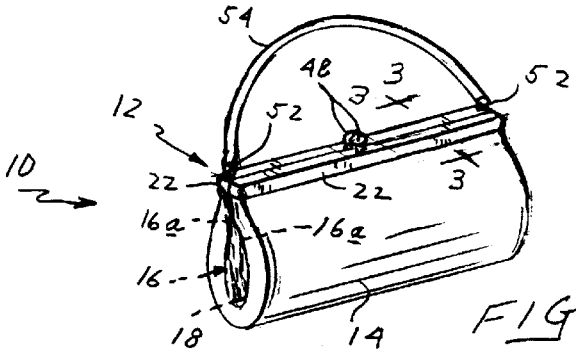
FIG. 1 is a perspective view of a woman's purse or clutch incorporating the invention.

Referring to FIG. 1, a purse shown generally at 10 comprises a frame indicated generally at 12 and a cover 14 releasably attached to frame 12.

Figure 2:
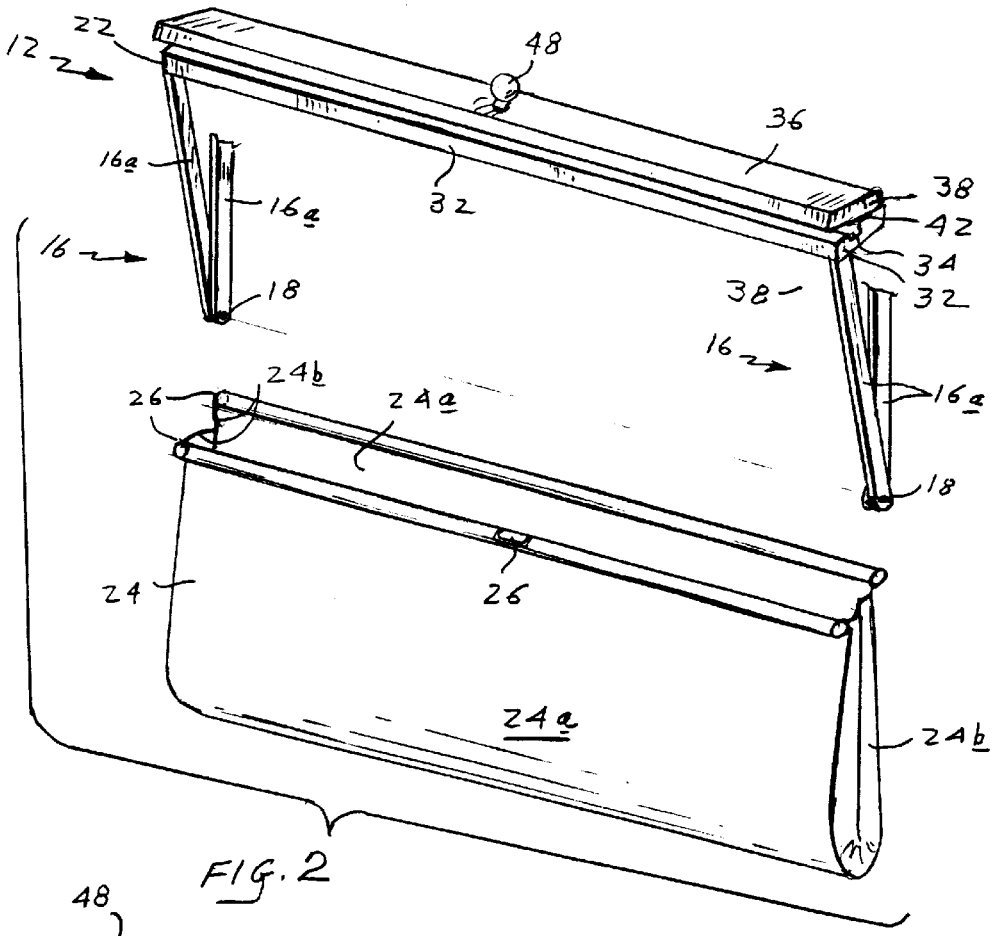
FIG. 2 is an exploded perspective view showing the components of the FIG. 1 purse in greater detail.

As best seen in FIG. 2, frame 12 comprises a pair of spaced-apart V-frames 16 each frame comprising a pair of legs 16*a* whose lower ends are connected by a pivot or hinge 18 and whose upper ends are secured to corresponding ends of a pair of mirror image rails 22 only one of which is shown in FIG. 2.

Still referring to FIG. 2, cover 14 comprises an enclosure or pouch 24 made of any suitable flexible material such as leather, plastic, woven fabric or the like. The enclosure may be provided with any suitable exterior color or design. Preferably, enclosure 24 has a pair of opposite side walls 24*a*, which may be formed of a continuous strip of material which also forms the bottom wall of the enclosure, and a pair of end walls 24*b* extending between the end edges of the side walls 24*a*. As shown in FIG.2, a pair of relatively rigid rods 26 are hemmed into the upper edge margins of side walls 24*a*. Preferably, the end walls 24*b* include enough material so that the rods 26 may be spread apart providing an opening into enclosure 24. On the other hand, when rods 26 are brought together, the opening into enclosure 24 is closed.

Figure 3:
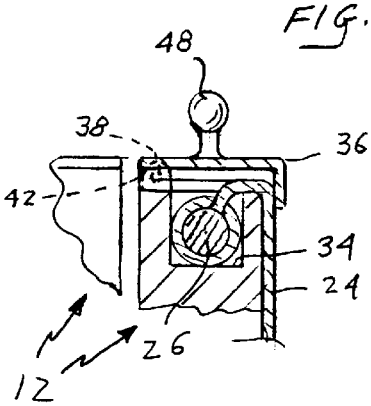
FIG. 3 is a fragmentary sectional view on a larger scale taken along line 3—3 of FIG. 1.

Referring now to FIGS. 2 and 3, each rail 12 comprises an elongated rigid beam 32 with a longitudinal groove 34 extending the entire length of beam 32. Groove 34 is sized to receive the hemmed rod 26 at the upper edge of the side wall 24*a* at the corresponding side of purse 10 as shown in FIG. 3. The rod is releasably secured in groove 34 by a closure assembly which may be similar to an elongated version of a conventional suspender clip. In the illustrated purse, each rail 22 includes an elongated cover member 36 hinged at 38 to the side of beam 32 facing the other rail 22. Also, at least one spring member 42 extends between the beam and the cover member. At the pivot, cover member 36 may be swung between an open position shown in FIG. 2 and a closed position illustrated in FIG. 3. When member 36 is in its open position, the groove 34 in beam 32 is exposed allowing a hemmed rod 26 to be inserted into, or removed from the groove 34 of the corresponding rail 22. On the other hand, when the cover member 36 is swung to its closed position shown in FIG. 3, the spring member 42 biases the cover member against beam 32 over groove 34 thereby locking the hemmed rod 26 in the groove. As shown in FIG. 1, when the cover member 36 is in its closed position, it provides a finished surface all along the top of rail 22.

In order to releasably lock purse 10 in its closed condition shown in FIG. 1, a knob 48 may be mounted to the top of each closed cover member 36, with the knobs being arranged and adapted to overlap or interfit in the usual way as shown in FIG. 1.

Also, if desired, eyes 52 may be provided at the opposite ends of at least one rail 22 to provide attachment points for the opposite ends of a shoulder strap 54 having end clips that may be clipped to the eyes. Shoulder strap 54 may be in the form of a chain, cord or the like designed to coordinate with the frame.

Figure 4:
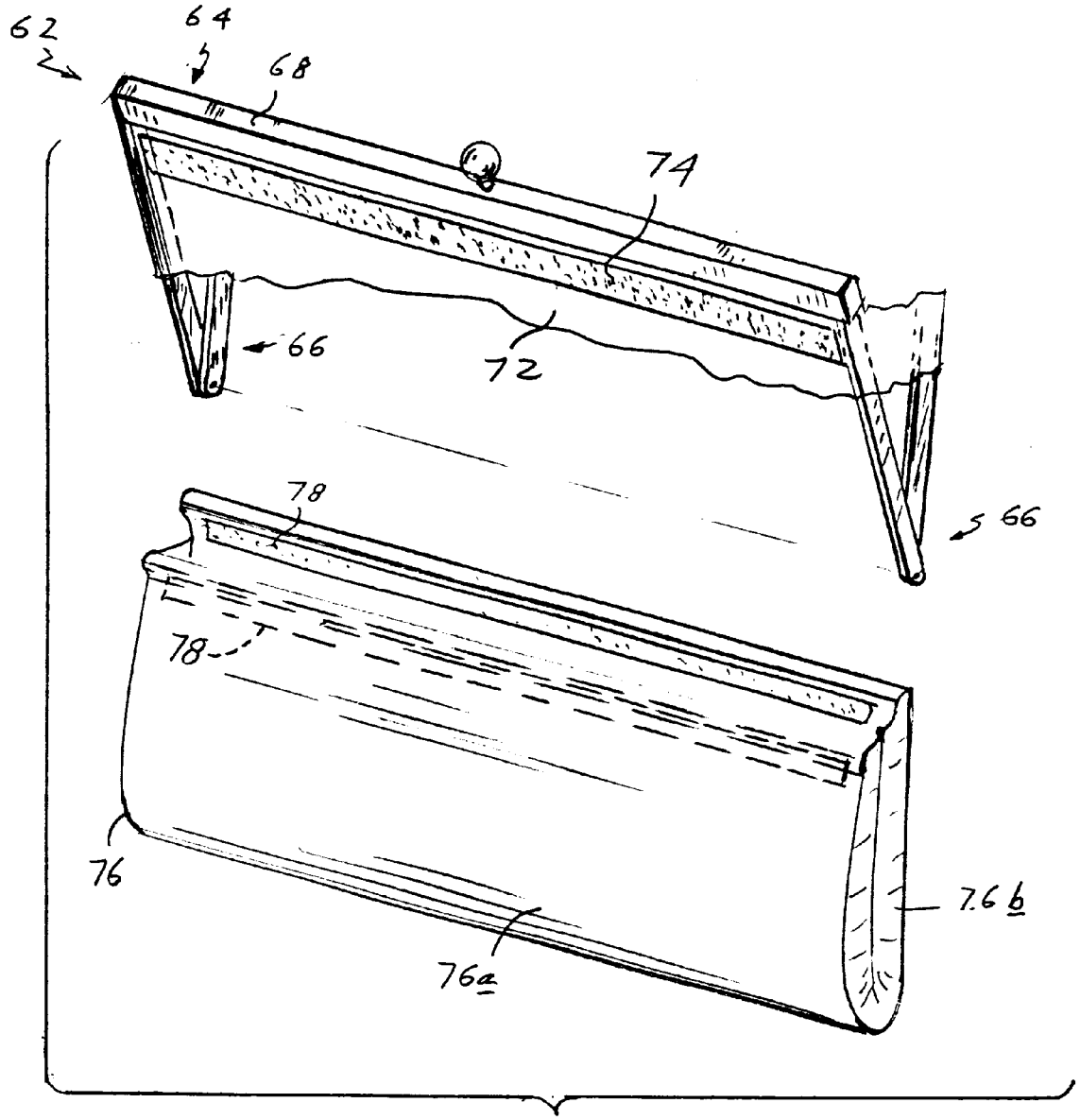
FIG. 4 is a view similar to FIG. 2 showing another purse embodiment.

Refer now to FIG. 4 which shows generally at 62 another purse embodiment incorporating my invention. Purse 62 comprises a frame shown generally at 64 which includes of a pair of V-frames 66 similar to frames 16. That is, they have legs the lower ends of which are hinged and the upper ends of which are connected to parallel rails 68, only one of which is shown in FIG. 4. In this case, a liner 72 is permanently attached to the rails forming a pocket which may be opened and closed along with the frame. In accordance with the invention, fastening means 74 extend along the upper exterior edge margins of liner 72 at opposite sides of the purse. The fastener means 74 may be hook and loop fastener strips, a series of snap fasteners, buttons, etc.

Purse 62 also includes a cover 76 having opposite side walls 76*a* and end walls 76*b* connecting opposite ends of the side walls so as to form an enclosure or pouch.

As shown in FIG. 4, fastening means 78 are provided at the interior upper edge margins of side walls 76*a*. Fastening means 78 are arranged and adapted to cooperate with the exterior fastening means 74 on liner 72. Thus, the cover 76 may be engaged over the lined frame 62 and releasably connected to the frame by means of the fastening means 74, 78.

It will be apparent from the foregoing that a single frame structure may be used with a variety of different covers to give the purses described herein a variety of different exterior colors and/or ornamental designs to suit different occasions. Therefore, these purses should find wide acceptance in the market place.

It will thus be seen that the objects set forth above, among those made apparent from the preceding description, are efficiently attained. Also, since certain changes may be made in the above constructions without departing from the scope of the invention, it is intended that all matter contained in the above description or shown in the accompanying drawings shall be interpreted as illustrative and not in a limiting sense.

What is claimed is:

1. A purse comprising a frame including a pair of elongated parallel rails and a pair of hinged V-frames connected to opposite end of the rails which allow the rails to be moved between spaced apart and closed together parallel positions;

a cover defining an enclosure sized to fit around the frame when the rails are in both of said positions, said cover including opposite side walls with upper edge margins, and cooperating fastening means on the frame and on the cover for releasably securing the side wall upper edge margins of the cover to the rails of the frame;

where in said fastening means comprises a rod extending along and secured to each side wall upper edge margin of cover, and clipping means extending along each rail, said clipping means being arranged and adapted to clip to the rod at the corresponding side of the cover, wherein each rail comprises a beam having a longitudinal groove extending along the beam and sized to receive the rod at the corresponding side of the cover; an elongated cover member hinged to the beam at one side of the groove so that the cover member can pivot between a closed position when it overlies the groove and an open position when it exposes the groove; and a spring biased member adapted to bias the cover member against the beam over the groove thereby clamping the rod to the beam.

2. The purse defined in claim 1 and further including means at the opposite ends of at least one of the rails for fastening said one rail to the opposite ends of a shoulder strap.

* * * * *